US007331091B2

(12) United States Patent
Strandqvist

(10) Patent No.: US 7,331,091 B2
(45) Date of Patent: Feb. 19, 2008

(54) METHOD OF PRODUCING A NONWOVEN MATERIAL

(75) Inventor: Mikael Strandqvist, Lindome (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 11/521,378

(22) Filed: Sep. 15, 2006

(65) Prior Publication Data

US 2007/0010156 A1 Jan. 11, 2007

Related U.S. Application Data

(63) Continuation of application No. PCT/SE2004/000392, filed on Mar. 18, 2004.

(51) Int. Cl.
*D04H 5/02* (2006.01)

(52) U.S. Cl. ..... 28/104

(58) Field of Classification Search ..... 28/104, 28/105, 167, 106; 162/115, 202, 91, 146, 162/212, 103, 125, 129, 130; 264/518, 557
See application file for complete search history.

(56) References Cited

U.S. PATENT DOCUMENTS

| | | | | |
|---|---|---|---|---|
| 4,190,695 | A | 2/1980 | Niederhauser | |
| 4,808,467 | A * | 2/1989 | Suskind et al. | 442/384 |
| 5,290,628 | A * | 3/1994 | Lim et al. | 442/408 |
| 5,389,202 | A | 2/1995 | Everhart et al. | |
| 5,413,849 | A * | 5/1995 | Austin et al. | 442/329 |
| 5,573,841 | A * | 11/1996 | Adam et al. | 428/219 |
| 6,063,717 | A * | 5/2000 | Ishiyama et al. | 442/387 |
| 6,163,943 | A * | 12/2000 | Johansson et al. | 28/104 |
| 6,550,115 | B1 * | 4/2003 | Skoog et al. | 28/104 |
| 2002/0157766 | A1 | 10/2002 | Viullaume et al. | |
| 2003/0213108 | A1 * | 11/2003 | Strandqvist | 28/104 |
| 2003/0217448 | A1 * | 11/2003 | Andersen | 28/104 |
| 2005/0188513 | A1 * | 9/2005 | Vuillaume et al. | 28/103 |

FOREIGN PATENT DOCUMENTS

| | | |
|---|---|---|
| EP | 0 308 320 | 3/1989 |
| EP | 1 215 325 | 6/2002 |
| WO | WO 99/22059 | 5/1999 |

* cited by examiner

*Primary Examiner*—Amy B. Vanatta
(74) *Attorney, Agent, or Firm*—Young & Thompson

(57) ABSTRACT

A method of producing a patterned and/or apertured nonwoven material wherein a web of continuous filaments are formed on a forming member, the continuous filaments being free from each other without any thermal or adhesive bonds therebetween, and applying a wetformed fiber dispersion containing natural and/or synthetic or regenerated staple fibers on top of the synthetic filaments. The web is hydroentangled, from the side on which the natural fibers and/or staple fibers are applied, in two subsequent hydroentangling stations and is between the hydroentangling stations transferred from a first hydroentangling wire having a mesh value of at least 20 mesh/cm, to a second hydroentangling wire, having a mesh value of no more than 15 mesh/cm. A nonwoven material is obtained having one side with predominantly continuous filaments and one side with predominantly natural fibers and/or synthetic staple fibers, wherein the material on the side with predominantly natural fibers and/or synthetic staple fibers has a three-dimensionally patterned structure and that natural fibers and/or synthetic staple fibers are penetrating into the layer of continuous filaments and are protruding through the layer of continuous filament.

18 Claims, 4 Drawing Sheets

METHOD OF PRODUCING A NONWOVEN MATERIAL

FIELD OF THE INVENTION

The present invention refers to a method of producing a nonwoven material comprising forming a fibrous web of continuous filaments and natural fibres and/or synthetic staple fibres, and subsequently hydroentangling the fibrous web while supported by an entangling member.

BACKGROUND OF THE INVENTION

Hydroentangling or spunlacing is a technique introduced during the 1970'ies, see e.g. CA 841,938. The method involves forming a fibre web which is either drylaid or wetlaid, after which the fibres are entangled by means of very fine water jets under high pressure. Several rows of water jets are directed against the fibre web which is supported by an entangling member in the form of a movable wire or a perforated rotatable drum. The entangled fibre web is then dried. The fibres that are used in the material can be synthetic or regenerated staple fibres, e.g. polyester, polyamide, polypropylene, rayon or the like, pulp fibres or mixtures of pulp fibres and synthetic staple fibres. Spunlaced materials can be produced with high quality to a reasonable cost and have a high absorption capacity. They can e.g. be used as wiping material for household or industrial use, as disposable materials in medical care and for hygiene purposes, etc.

Through EP-B-333,211 and EP-B-333,228 it is known to hydroentangle a fibre mixture in which one type of fibres is meltblown fibres. The polymers used for the continuous filaments are mostly polyolefins, especially polypropylene and polyethylene, or polyethylene terephtalate, polybutylene terephtalate, polyvinyl chloride etc. The base material, i.e. the fibrous material which is exerted to hydroentangling, either consists of at least two preformed fibrous layers, where one layer is composed of meltblown fibres or of a "coformed material", in which an essentially homogeneous mixture of meltblown fibres and other fibres is airlaid on a wire.

Through EP-A-308,320 it is known to bring together a web of bonded continuous filaments with wetlaid fibrous material containing pulp fibres and staple fibres. The separately formed fibrous webs are hydroentangled together to form a laminate. In such a material the fibres of the different fibrous webs will not be well integrated with each other since the continuous fibres are pre-bonded. This pre-bonding of the continuous filament will during the hydroentangling procedure limit the mobility and thereby result in a material with limited integration.

Through WO 92/08834 it is known to air-lay staple fibres on a forming wire and on top thereof air-lay defibrated pulp fibres. The formed fibrous web is then subjected to three steps of hydroentanglement. In the first step the web is hydroentangled against a fine-mesh wire and is then transferred to coarse-mesh screen on which it is exerted to a second hydroentangling. In this second hydroentangling step the water jets will press loose fibre ends through the coarse meshes in the wire. The web is then transferred to a third fine-mesh wire and hydroentangled a third time in order to ensure that those loose fiber ends will be folded against the fine-mesh wire and be intertwined and firmly secured to the web. This is told to produce a spunlace material having a high wear resistance.

Through U.S. Pat. No. 5,459,912 it is known to make patterned spunlace materials comprising woodpulp fibers and synthetic fibers. The synthetic fibers may be in the form of textile staple fibers or spunbonded fibers. The spunbonded fibers are in the form of a spunbonded web of filaments, which means that the filaments are thermally bonded to each other and cannot move and integrate with the other fibers during the hydroentangling.

WO 99/20821 discloses a method of making a composite nonwoven material, wherein a fibres and a web of continuous filaments, such as a spunbond or meltblown web, are hydroentangled, a bonding material is applied to the web, which is subsequently creped. Again the web of continuous filaments is a web wherein the filaments are bonded to each other.

Through EP-B-938,601 it is known to bring together a web of continuous filaments with foam formed fibrous material containing pulp fibres and synthetic staple fibres. The resulting web is then hydroentangled together to a composite material in one hydroentangling step. The continuous filaments are substantially free from each other before hydroentangling and the resulting material will show an integration between the foam formed material and the continuous filaments.

There is however still room for improvements especially with respect to hydroentangled materials having a patterned and/or apertured structure and a good integration between continuous filaments and other fibers contained in the web.

SUMMARY OF THE INVENTION

The object of the present invention is to provide a method of making a hydroentangled nonwoven material comprising continuous filaments and natural fibres and/or synthetic staple fibres, in which the continuous filaments are well integrated with the other fibers and the material has a patterned and/or apertured structure. This has according to the invention been obtained by forming a web of continuous filaments on a forming member, the continuous filaments being free from each other without any thermal or adhesive bonds therebetween, and applying a wetformed fiber dispersion containing natural fibers and/or synthetic or regenerated staple fibers on top of said synthetic filaments, thus forming a fibrous web containing said continuous filaments and said natural fibers and/or staple fibers and subsequently hydroentangling the fibrous web, the web during hydroentangling being supported by a first entangling member, wherein the fibrous web is hydroentangled, from the side on which the natural fibers and/or staple fibers are applied, in two subsequent hydroentangling stations and is between said hydroentangling stations transferred from said first entangling member to a second entangling member, wherein said first entangling member has a mesh value of at least 20 mesh/cm and the second entangling member has a mesh value of no more than 15 mesh/cm. After the second hydroentangling station the web is dried without additional hydroentangling.

According to one aspect of the invention no hydroentangling of the fibrous web takes place from the side on which the continuous filaments are applied.

According to one embodiment the natural fibres and/or the synthetic staple fibres are deposited on top of a web of continuous filaments.

According to a further embodiment the natural fibres and/or the synthetic staple fibres are applied in the form of a wet- or foam formed fiber dispersion on top of the continuous filaments.

In one aspect of the invention the first entangling wire has a mesh value of at least 30 mesh/cm, preferably a mesh value between 30 and 50 mesh/cm. It further may have a count value of at least 17, preferably at least 23 count/cm, and more preferably it has a count value between 23 and 35 count/cm.

In a further aspect of the invention the second entangling wire has a mesh value of no more than 12 mesh/cm, preferably-no more than 10 mesh/cm and most preferably it has a mesh value between 6 and 10 mesh/cm. The second entangling wire may further have a count value of no more than 15, preferably no more than 12, more preferably no more than 11 and most preferably it has a count value between 6 and 11 count/cm.

In one embodiment the continuous filaments are spunlaid filaments.

In a further embodiment the fibrous web comprises between 0.5 and 50% by weight, preferably between 15 and 30% by weight, continuous filaments.

In one aspect of the invention the fibrous web comprises between 20 and 85% by weight, preferably between 40 and 75% by weight natural fibers.

The natural fibers are according to one embodiment pulp fibers.

In a further aspect of the invention the fibrous web comprises between 5 and 50% by weight, preferably between 5 and 20% by weight synthetic or regenerated staple fibers.

According to one embodiment at least a major part of the synthetic staple fibres have a fiber length between 3 and 7 mm.

According to one aspect of the invention apertures are formed in the fibrous web in the second entangling station.

BRIEF DESCRIPTION OF THE DRAWINGS

The invention will below be closer described with reference to an embodiment shown in the accompanying drawings.

DETAILED DESCRIPTION OF THE INVENTION

Figure 1:
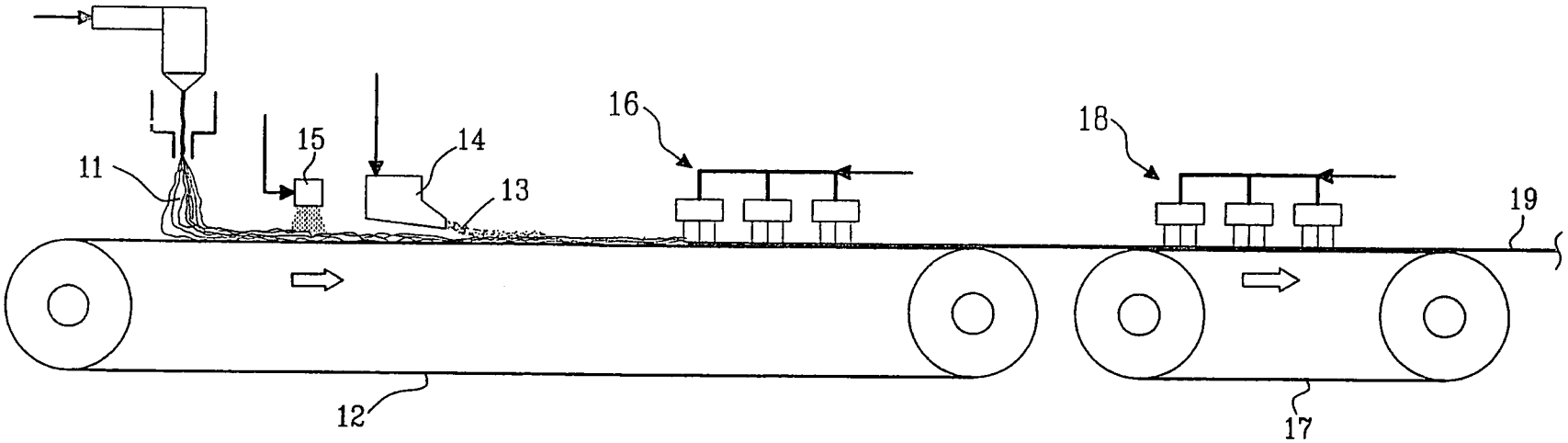
FIG. 1 shows schematically an embodiment of a process for producing a hydroentangled nonwoven material according to the invention.

The hydroentangled composite material according to the invention comprises a mixture of continuous filaments and natural fibers and/or synthetic staple fibers. These different types of fibers are defined as follows.

Continuous Filaments

The continuous filaments are fibers that in proportion to their diameter are very long, in principle endless. They can be produced by extruding a molten thermoplastic polymer through fine nozzles, whereafter the polymer will be cooled and drawn, preferably by the action of an air flow blown at and along the polymer streams, and solidified into strands that can be treated by drawing, stretching or crimping. Chemicals for additional functions can be added to the surface.

Filaments can also be regenerated fibers produced by chemical reaction of a solution of fiber-forming reactants entering a reagent medium, for example by spinning of regenerated cellulose fibers from a cellulose xanthate solution into sulphuric acid. Examples of regenerated cellulose fibers are rayon, viscose or lyocell fibers.

Continuous filaments may be in the form of spunlaid filaments or meltblown filaments. Spunlaid filaments are produced by extruding a molten polymer, cool and stretch to an appropriate diameter. The fiber diameter is usually above 10 μm, e. g. between 10 and 100 μm. Production of spunlaid filaments is described for example in U.S. Pat. Nos. 4,813,864 and 5,545,371.

Meltblown filaments are formed by means of a meltblown equipment 10, for example of the kind shown in the U.S. Pat. Nos. 3,849,241 or 4,048,364. The method shortly involves that a molten polymer is extruded through a nozzle in very fine streams and converging air streams are directed towards the polymer streams so that they are drawn out into continuous filaments with a very small diameter. The filaments can be microfibers or macrofibers depending on their dimension. Microfibers have a diameter of up to 20 μm, but usually are in the interval between 2 and 12 μm in diameter. Macrofibers have a diameter of over 20 μm, e. g. between 20 and 100 μm.

All thermoplastic polymers can in principle be used for producing spunlaid and meltblown filaments. Examples of useful polymers are polyolefins, such as polyethylene and polypropylene, polyamides, polyesters and polylactides. Copolymers of these polymers may of course also be used.

Tow is another type of filaments, which normally are the starting material in the production of staple fibers, but which also is sold and used as a product of its own. In the same way as in the production of with spunlaid fibers, tow is produced from fine polymer streams that are drawn out and stretched, but instead of being laid down on a moving surface to form a web, they are kept in a bundle to finalize drawing and stretching. When staple fibers are produced, this bundle of filaments is then treated with spin finish chemicals, are often crimped and then fed into a cutting stage where a wheel with knives will cut the filaments into distinct fiber lengths that are packed into bales to be shipped and used as staple fibers. When tow is produced, the filament bundles are packed, with or without spin finish chemicals, into bales or boxes.

The continuous filaments will in the following be described as spunlaid fibers, but it is understood that also other types of continuous filaments, e. g. meltblown fibers, can be used. Preferably spunlaid filaments are used, since they result in a stronger material. In this case it is an advantage having the stronger spunlaid filaments, as they withstand the mechanical agitation exerted by the water jets. The spunlaid filaments are easily movable by the action of the water jets and will create patterns and apertures in the web material. The weaker meltblown filaments may break during hydroentangling.

Natural Fibers

The natural fibers are usually cellulose fibers, such as pulp fibers or fibers from grass or straw. Pulp fibers are the most commonly used natural fibers and are used in the material for their tendency to absorb water and for their tendency to create a coherent sheet. Both softwood fibers and hardwood fibers are suitable, and also recycled fibers can be used, as well as blends of these types of fibers. The fiber lengths will vary from around 2-3 mm for softwood fibers and around 1-1.5 mm for hardwood fibers, and even shorter for recycled fibers.

Staple Fibers

The staple fibers used can be produced from the same substances and by the same processes as the filaments discussed above. They may either be synthetic fibers or regenerated cellulose fibers, such as rayon, viscose or lyocell. The cutting of the fiber bundles is normally done to result in a single cut length, which can be altered by varying the distances between the knives of the cutting wheel. The fiber lengths of conventional wetlaid hydroentangled non-wovens are usually in the interval 12-18 mm. However according to the present invention also shorter fiber lengths, from about 2-3 mm, can be used.

The Process

According to the embodiment shown in FIG. 1 continuous filaments 11 in the form of spunlaid fibers are produced by extruding a molten polymer, cool it and stretch it to an appropriate diameter. The fiber diameter is usually above 10 μm, e. g. between 10 and 100 μm.

In an alternative embodiment meltblown fibers are formed by means of a meltblown equipment. The meltblown technique shortly involves that a molten polymer is extruded through a nozzle in very fine streams and converging air streams are directed towards the polymer streams so that they are drawn out into continuous filaments with a very small diameter.

The fibers can be microfibers or macrofibers depending on their dimension. Microfibers have a diameter of up to 20 μm, but usually are in the interval between 2 and 12 μm in diameter. Macrofibers have a diameter of over 20 μm, e. g. between 20 and 100 μm.

All thermoplastic polymers can in principle be used for producing spunlaid and meltblown fibers. Examples of useful polymers are polyolefins, such as polyethylene and polypropylene, polyamides, polyesters and polylactides. Copolymers of these polymers may of course also be used.

According to the embodiment shown in FIG. 1 the spunlaid fibers 11 are laid down directly on a forming wire 12 where they are allowed to form a relatively loose, open web structure in which the fibers are relatively free from each other. This is achieved by making the distance between the spunlaying nozzle and the wire relatively large, so that the filaments are allowed to cool down before they land on the wire 12. The basis weight of the formed spunlaid layer should be between 2 and 50 g/m$^2$ and the bulk between 5 and 15 cm$^3$/g.

An aqueous or a foamed fibrous dispersion 13 from a headbox 14 is laid on top of the spunlaid filaments. In wet laying technique the fibers are dispersed in water, with optional additives, and the fiber dispersion is dewatered on a forming fabric to form a wet laid fibrous web. In the foam forming technique, which is a special variant of wet-laying, a fibrous web is formed from a dispersion of fibers in a foamed liquid containing water and a surfactant. The foam forming technique is described in for example GB 1,329,409, U.S. Pat. No. 4,443,297, WO 96/02701 and EP-A-0 938 601. A foam-formed fibrous web has a very uniform fiber formation. For a more detailed description of the foam forming technique reference is made to the above mentioned documents.

The spunlaid filaments and the fiber dispersion of natural fibers and/or synthetic staple fibers may be formed on the same or on different wires. The web of spunlaid filaments laid on the wire 12 has a rather low basis weight and is substantially unbonded, which means that the web is very weak and has to be handled and transferred to the next forming station, the headbox 14, very gently.

In order to provide a certain consolidation of the web of spunlaid filaments and avoid that the web is damaged on its way to the headbox, moisture is according to one embodiment of the invention applied to the web by a spray bar 15 or gentle shower before laying the wet- or foam formed fiber dispersion on the web of the continuous filaments. By this the web of continuous filaments is flattened out and a firm contact between the web and the forming wire is established before it enters the headbox zone, in which the wet- or foam formed fiber dispersion is laid on top of the web of continuous filaments. The wettening of the filaments takes place at a very low pressure so that no substantial bonding or sideways displacement of the fibers take place. The surface tension of the water will adhere the filaments to the wire so the formation will not distort while entering the headbox. The term "no substantial bonding" as used herein means that there will be no substantial bonding effect in addition to what is caused by the surface tension of the liquid used. In some cases, when hydrophobic polymers are used for forming the spunlaid filaments, a small amount of a surfactant, between 0.001 and 0.1% by weight, may be added to the water used for moistening the spunlaid filaments.

Fibers of many different kinds and in different mixing proportions can be used for making the wet laid or foam formed fibrous web. Thus there can be used pulp fibers or mixtures of pulp fibers and synthetic staple fibers, e g polyester, polypropylene, rayon, lyocell etc. Varying fiber lengths can be used. However, according to the invention, it is of advantage to use relatively short staple fibers, below 10 mm, preferably in the interval 2 to 8 mm and more preferably 3 to 7 mm. This is for some applications an advantage because the short fibers will more easily mix and integrate with the spunlaid filaments than longer fibers. There will also be more fiber ends sticking out form the material, which increases softness and textile feeling of the material. For short staple fibers both wet laying and foam forming techniques may be used.

As a substitute for pulp fibers other natural fibers with a short fiber length may be used, e. g. esparto grass, phalaris arundinacea and straw from crop seed.

It is preferred that the fibrous web comprises as least between 20 and 85% by weight, preferably between 40 and 75% by weight natural fibers, for example pulp fibers.

It is further preferred that the fibrous web contains between 10 and 50% by weight, preferably between 15 and 30% by weight, continuous filaments, for example in the form of spunlaid or meltblown filaments.

The fiber dispersion laid on top of the spunlaid filaments is dewatered by suction boxes (not shown) arranged under the wire 12. The short pulp fibers and synthetic staple fibers are formed on top of the spunlaid web, which provides the necessary closeness and acts like an extra sieve for the formation of the short fibers.

The thus formed fibrous web comprising spunlaid filaments and other fibers is then hydroentangled in a first entangling station 16 including several rows of nozzles, from which very fine water jets under high pressure are directed against the fibrous web. In the embodiment shown the same wire 12 is used for supporting the web in the first entangling station 16 as for the formation of the web. Alternatively, the fibrous web can before hydroentangling be transferred to a special entangling wire. In both cases the web is entangled from the natural/staple fiber side in order to obtain a penetration of the short natural fibers/staple fibers into the filament web.

The wire or screen 12 supporting the web in the first hydroentangling step is relatively fine mesh, at least 20 mesh/cm and preferably at least 30 mesh/cm. Most preferably the wire supporting the web in the first hydroentangling station has a mesh value between 30 and 50 mesh/cm. For a woven wire mesh value is herewith defined as the number of monofilament strands in the warp direction of the wire.

The wire 12 may be woven wire or another fluid permeable screen member adapted to support a fibrous web during hydroentangling. An example of such a screen is a moulded, close-mesh screen of thermoplastic material as disclosed in WO 01/88261. The mesh number is in this case defined as the number of strands of thermoplastic material extending between apertures of the screen in the machine direction. A similar definition is given the mesh value for other types of screens adapted for hydroentangling.

The wire further has a count of at least 17 and preferably at least 23 count/cm. Most preferably it has a count value between 23 and 35 count/cm. For a woven wire the count value is defined as the number of monofilament strands in the shute direction per cm of the wire. For other types of screens which are not woven wires, the count value is defined as the number of strands of material extending between apertures of the screen in cross direction.

After the first hydroentangling station the web is transferred to a second hydroentangling wire or screen 17, which supports the fibrous web in a second hydroentangling station 18 including several rows of nozzles, from which very fine water jets under high pressure are directed against the fibrous web. The hydroentangling takes place from the same side of the fibrous web as in the first hydroentangling station, i.e. from the natural fiber/staple fiber side. The wire or screen 17 used in the second hydroentangling step is relatively coarse and has a mesh value of no more than 15, preferably no more than 12 and more preferably no more than 10 mesh/cm. Most preferably the wire 17 has a mesh value between 6 and 19 mesh/cm. Mesh value is defined for woven wires and for other screens as above.

The wire or screen 17 further has a count value, as defined above, of no more than 15, preferably no more than 12 count/cm and preferably no more than 11. Most preferably it has a count value between 6 and 11 count/cm.

It is important that the filaments are relatively unbonded and displaceable after the first hydroentangling step, so as to permit a certain rearrangement and mobility of the fibers and filaments in the second hydroentangling station 18 by the action of the water jets. This will create a good penetration of the short natural fibers/staple fibers into the filament web and thus a good integration of the fibers and filaments. Due to the relatively coarse wire or screen 17 a patterning effect and even the creation of apertures in the fibrous material are obtained in the second hydroentangling station 18.

In a preferred embodiment a woven wire is used at least in the second hydroentangling step, since a woven wire normally has a more pronounced three-dimensional structure as compared to a screen of other kind.

Fibrous webs having a three-dimensional patterned structure and/or apertures have certain advantages for example when used as wiping material, since they provide an improved cleaning effect especially for viscous substances and particles.

After the hydroentangling the material 17 is dried and wound up. The material is then converted in a known manner to a suitable format and is packed. Since it is preferred to have closed loops of process water as far as this is possible, the water that has been dewatered at the forming, moistening and hydroentangling steps is preferably recirculated.

EXAMPLE

A hydroentangled fibrous web was produced containing a combination of spunlaid filaments and pulp fibers. The following proportion of filaments and fibers were used:

25% by weight spunlaid filaments, PP 3 dtex; 75% by weight pulp fibers.

The pulp fibers were supplied by wet-laying. The fibrous web was hydroentangled in a first hydroentangling station while supported on a Flex 310 K wire supplid by Albany International, which has a mesh value of 41 and a count value of 30.5 per cm. The energy input in the first hydroentangling step was relatively low, about 100 kWh/t. The first hydroentangling station comprised 1 row of nozzles with a pressure of 79 bar (1×79 bar). The web was fed through the first entangling station at a speed of 24 m/min. The web was subsequently hydroentangled in a second hydroentangling station while supported on a Combo 213 B wire supplied by Albany International having a mesh of 9 and a count of 10 per cm. The second hydroentangling station comprised 3 rows of nozzles with a pressure of 100 bar (3×100 bar). The web was fed through the second entangling station at a speed of 144 m/min and the energy input in the second hydroentangling station was 80 kWh/t, The resulting material had a thickness of 799 μm, a grammage of 86.7 g/m$^2$ and a bulk of 9.2 g/m$^3$.

Figure 2:
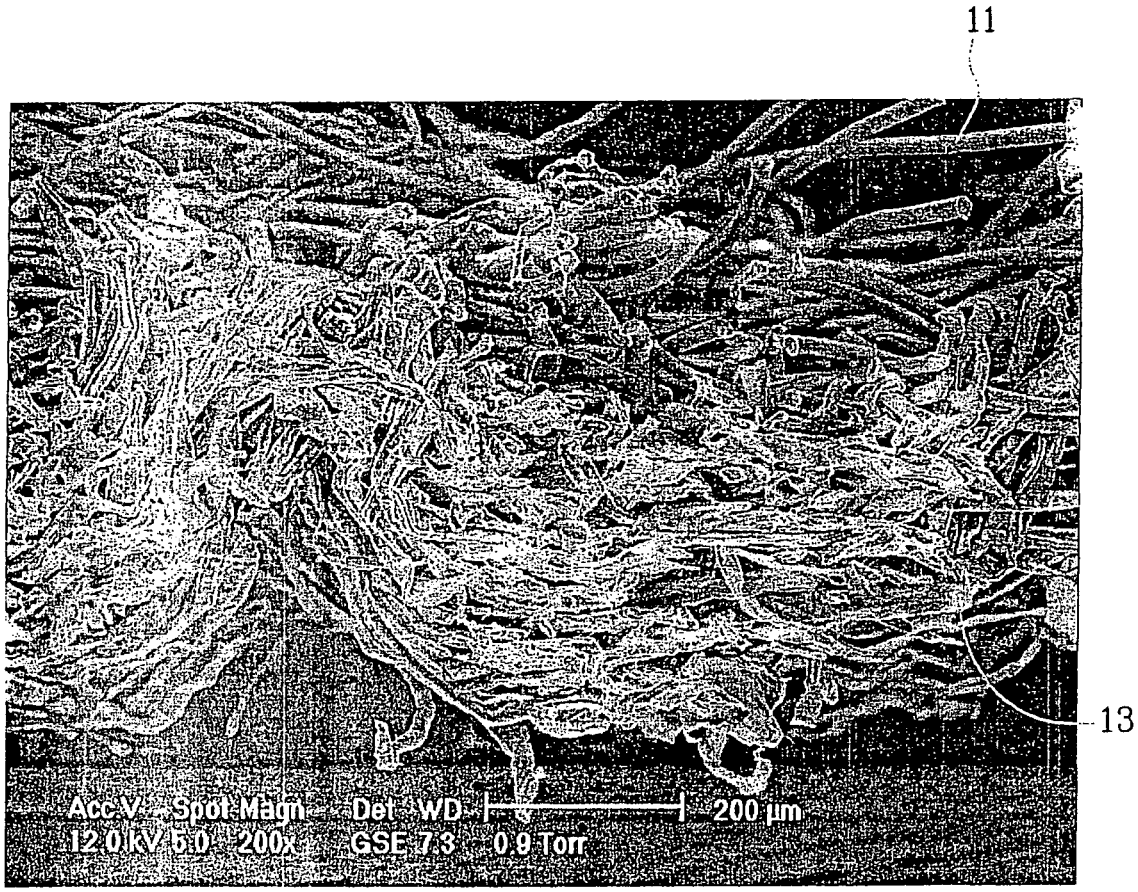
FIG. 2-4 show ESEM images of a nonwoven material produced according to the invention.
Figure 3:
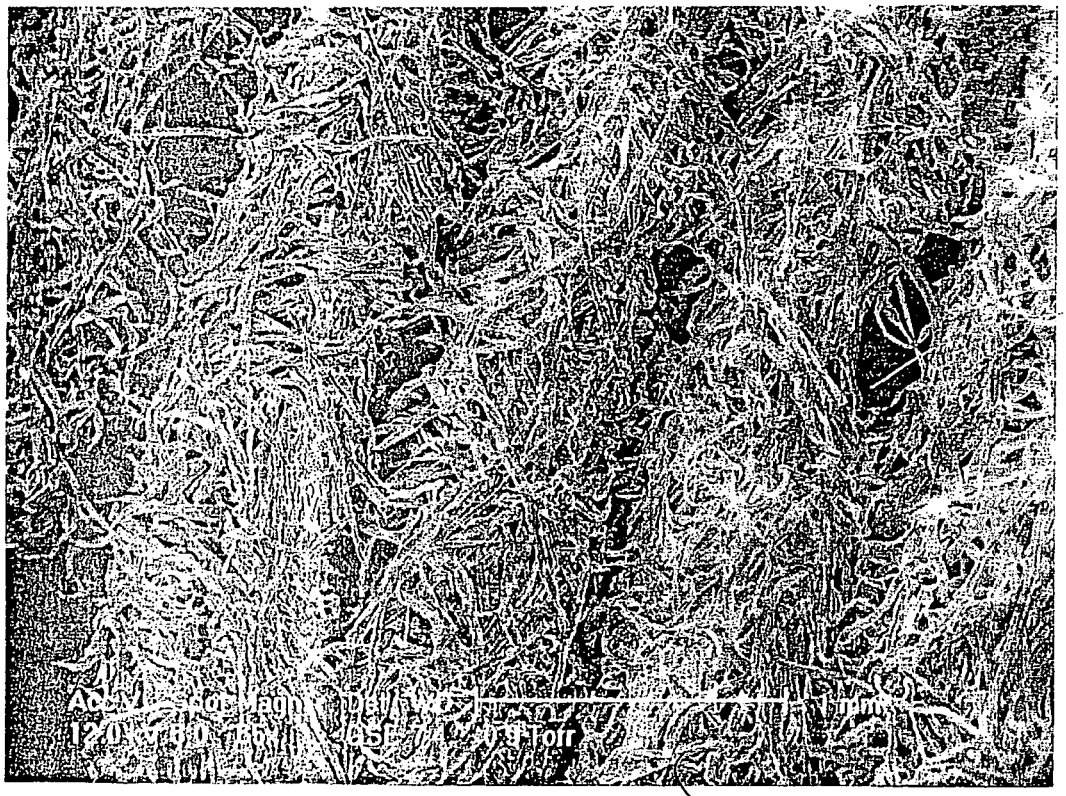
Figure 4:
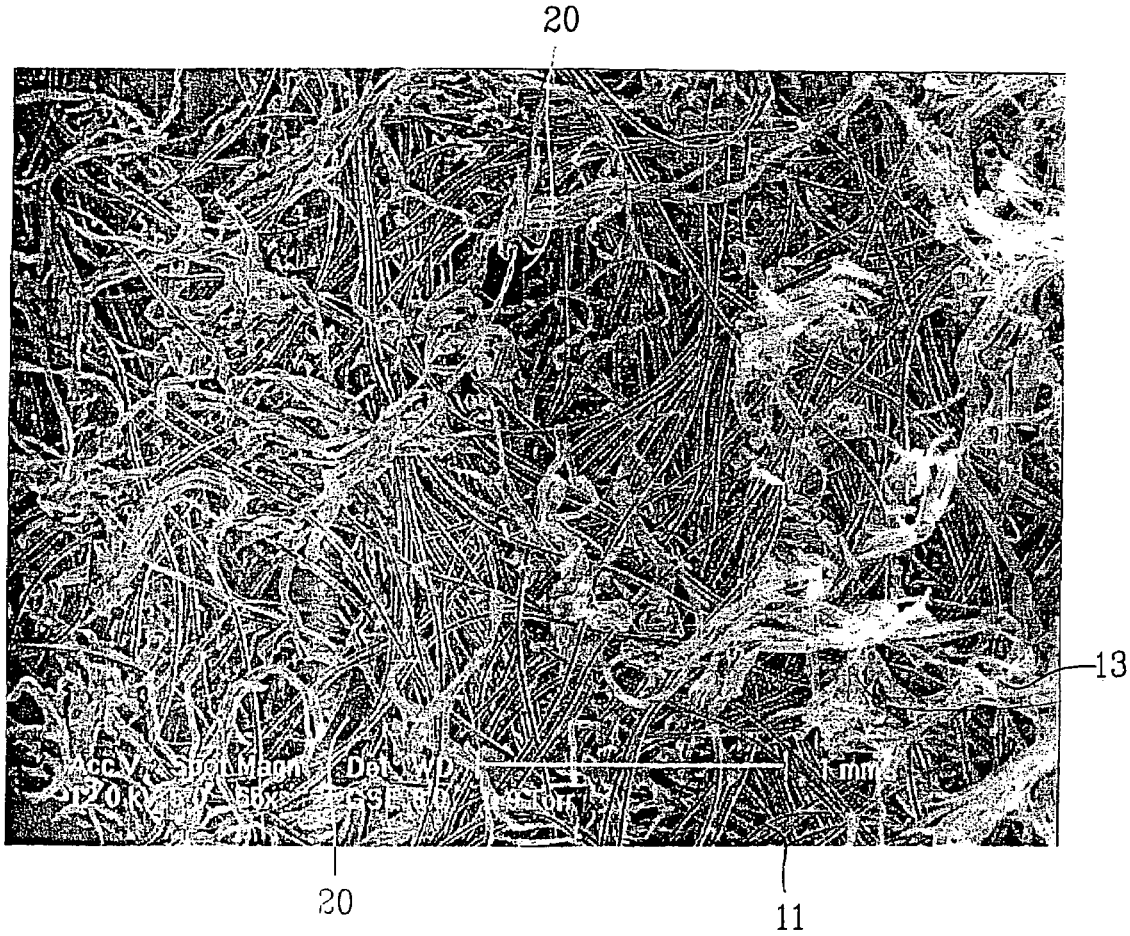

ESEM images of the material are shown in FIGS. 2-4, wherein FIG. 2 shows a cross section through the material in a magnification of 200×. FIG. 3 shows the material in a magnification of 65× from the pulp fiber/staple fiber side and FIG. 4 shows the material in a magnification of 65× from the spunlaid filament side. The spunlaid filaments are denoted by the numeral 11 and the shorter pulp fibers/staple fibers are denoted by the numeral 13.

It can be seen from the images that the material has a distinct three-dimensional structure as viewed from the pulp fiber/staple fiber side, from which it has been hydroentangled. Apertures 20 extending through the material are also created which can be seen from FIGS. 3 and 4. FIGS. 1 and 2 further show that the pulp fibers/staple fibers have penetrated into and even through the spunlaid filament web and are protruding from the spunlaid side of the material. This indicates a good integration between the different types of fibers contained in the material.

The mechanical properties of the produced material is shown in Table 1 below. The properties are satisfactory and show that the patterned and apertured material according to the invention can be achieved without sacrificing other properties.

TABLE 1

| | |
|---|---|
| Basis weight (g/m$^2$) | 86.7 |
| Thickness 2 kPa (μm) | 799 |
| Bulk 2 kPa (cm$^3$/g) | 9.2 |
| Tensile stiffness MD (N/m) | 13228 |
| Tensile stiffness CD (N/m) | 1406 |
| Tensile strength dry MD (N/m) | 1431 |
| Tensile strength dry CD (N/m) | 801 |
| Stretch MD (%) | 58 |
| Stretch CD (%) | 108 |
| Work to rupture MD (J/m$^2$) | 793 |
| Work to rupture CD (J/m$^2$) | 599 |
| Work to rupture index (J/g) | 7.9 |
| Tensile strength MD, wet (N/m) | 1081 |
| Tensile strength CD, wet (N/m) | 828 |
| Abrasion resistance dry (Taber) | 3.5 |

The invention claimed is:

1. A method of producing a patterned and/or apertured nonwoven material comprising forming a web of continuous filaments on a forming member, the continuous filaments being free from each other without any thermal or adhesive bonds therebetween;

applying a wet- or foam formed fiber dispersion containing natural fibers and/or synthetic or regenerated staple fibers on top of said continuous filaments, thus forming a fibrous web containing said continuous filaments and said natural fibers and/or staple fibers; and subsequently hydroentangling the fibrous web, the web during hydroentangling being supported by a first entangling member, wherein the fibrous web is hydroentangled, from the side on which the natural fibers and/or staple fibers are applied, in two hydroentangling stations disposed one after the other, and between said hydroentangling stations is transferred from said first entangling member to a second entangling member, said first entangling member has a mesh value of at least 20 mesh/cm and the second entangling member has a mesh value of no more than 15 mesh/cm, and after the second hydroentangling station, drying the web without additional hydroentangling.

2. A method according to claim 1, wherein no hydroentangling of the fibrous web takes place from the side on which the continuous filaments are applied.

3. A method according to claim 1, wherein the natural fibres and/or the synthetic staple fibres are deposited on top of said web of continuous filaments.

4. A method according to claim 1, wherein the first entangling member has a mesh value of at least 30 mesh/cm.

5. A method according to claim 1, wherein the second entangling member has a mesh value of no more than 12 mesh/cm.

6. A method according to claim 1, wherein the first entangling member has a count value of at least 17.

7. A method according to claim 1, wherein the second entangling member has a count value of no more than 15.

8. A method according to claim 1, wherein at least the second entangling member is a woven wire.

9. A method according to claim 1, wherein the continuous filaments are spunlaid filaments.

10. A method according to claim 1, wherein the fibrous web comprises between 0.5 and 50% by weight of continuous filaments.

11. A method according to claim 1, wherein the fibrous web comprises between 20 and 85% by weight of natural fibers.

12. A method according to claim 11, wherein the natural fibers are pulp fibers.

13. A method according to claim 1, wherein the fibrous web comprises between 5 and 50% by weight of synthetic or regenerated staple fibers.

14. A method according to claim 13, wherein at least a major part of the synthetic staple fibres have a fiber length between 3 and 7 mm.

15. A method according to claim 1, wherein apertures are formed in the fibrous web in the second entangling station.

16. The method according to claim 1, wherein the first entangling member has a count value between 23 and 35 count/cm, and the second entangling member a count value between 6 and 11 count/cm.

17. A method according to claim 1, wherein the fibrous web comprises between 15 and 30% by weight of continuous filaments.

18. A method according to claim 1, wherein the fibrous web comprises between 40 and 75% by weight of natural fibers.

* * * * *